US012214851B1

(12) United States Patent
Nickols et al.

(10) Patent No.: US 12,214,851 B1
(45) Date of Patent: Feb. 4, 2025

(54) COPILOT DEVICES AND APPARATUSES FOR SUPPORTING MARINE DRIVES HAVING A COPILOT DEVICE

(71) Applicant: Brunswick Corporation, Mettawa, IL (US)

(72) Inventors: Thomas F. Nickols, Fond du Lac, WI (US); Robert A. Podell, Slinger, WI (US); Jeremy J. Kraus, Mt. Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 1 day.

(21) Appl. No.: 17/852,944

(22) Filed: Jun. 29, 2022

(51) Int. Cl.

| | |
|---|---|
| ***B63H 20/02*** | (2006.01) |
| ***B63H 20/12*** | (2006.01) |
| *B63H 20/06* | (2006.01) |
| *B63H 20/08* | (2006.01) |
| *B63H 25/02* | (2006.01) |

(52) U.S. Cl.
CPC ..... *B63H 20/12* (2013.01); *B63H 20/02* (2013.01); *B63H 20/06* (2013.01); *B63H 20/08* (2013.01); *B63H 25/02* (2013.01); *B63H 2025/024* (2013.01)

(58) Field of Classification Search
CPC ..... B63H 20/08; B63H 20/06; B63H 20/02; B63H 20/12; B63H 25/02; B63H 2025/024
See application file for complete search history.

(56) References Cited

U.S. PATENT DOCUMENTS

| | | | | |
|---|---|---|---|---|
| 1,451,452 A | | 4/1923 | Totten | |
| 2,549,481 A | * | 4/1951 | Kiekhaefer | B63H 23/321 74/480 B |
| 2,808,218 A | | 10/1957 | Steller | |
| 2,914,020 A | | 11/1959 | Van Raden | |
| 3,922,996 A | | 12/1975 | Meyer | |

(Continued)

FOREIGN PATENT DOCUMENTS

| | | | | |
|---|---|---|---|---|
| CN | 206590092 | | 10/2017 | |
| EP | 1101696 A2 | * | 5/2001 | B63H 20/36 |

(Continued)

OTHER PUBLICATIONS

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

(Continued)

*Primary Examiner* — Tan Le
(74) *Attorney, Agent, or Firm* — Andrus Intellectual Property Law, LLP

(57) ABSTRACT

An apparatus is for supporting a marine drive on a marine vessel. The apparatus has a transom bracket comprising a swivel cylinder and a steering bracket configured to couple the marine drive to the transom bracket, the steering bracket comprising a steering arm and a swivel tube seated in the swivel cylinder, wherein steering of the steering arm relative to the transom bracket rotates the swivel tube in the swivel cylinder and thereby steers the marine drive. A copilot device is configured to frictionally restrain rotation of the swivel tube in the swivel cylinder by applying diametrically opposing pushing and pulling forces on the swivel tube.

24 Claims, 11 Drawing Sheets

(56) References Cited

U.S. PATENT DOCUMENTS

| | | | | |
|---|---|---|---|---|
| 3,961,595 | A | 6/1976 | Meyer | |
| 4,018,104 | A | 4/1977 | Bland et al. | |
| 4,521,201 | A | 6/1985 | Watanabe | |
| 4,701,141 | A * | 10/1987 | Sumigawa | B63H 20/12 74/495 |
| 5,102,357 | A * | 4/1992 | Bruesch | B63H 20/12 248/643 |
| 5,180,319 | A | 1/1993 | Shiomo et al. | |
| 5,340,342 | A | 8/1994 | Boda et al. | |
| 5,582,527 | A | 12/1996 | Nakamura | |
| 6,053,471 | A | 4/2000 | Brown | |
| 6,146,221 | A | 11/2000 | Natsume | |
| 6,174,211 | B1 * | 1/2001 | Nakamura | B63H 20/12 440/55 |
| 6,283,806 | B1 | 9/2001 | Schmidt et al. | |
| 6,402,577 | B1 | 6/2002 | Treinen | |
| 6,659,817 | B1 | 12/2003 | Anderson et al. | |
| 6,902,450 | B2 | 6/2005 | Ohtsuki et al. | |
| 7,048,600 | B1 | 5/2006 | Broussard | |
| 7,090,551 | B1 | 8/2006 | Lokken et al. | |
| 7,244,152 | B1 | 7/2007 | Uppgard | |
| 7,297,035 | B2 | 11/2007 | Broussard | |
| 7,303,595 | B1 | 12/2007 | Janitz | |
| 7,311,571 | B1 | 12/2007 | Swan | |
| 7,314,396 | B2 | 1/2008 | Kubota et al. | |
| 7,410,397 | B2 | 2/2008 | Nakamura et al. | |
| 7,681,513 | B1 | 3/2010 | Hundertmark | |
| 7,896,304 | B1 | 3/2011 | Eichinger et al. | |
| 8,069,803 | B1 | 12/2011 | Crawford | |
| 8,795,010 | B1 | 8/2014 | Wiatrowski | |
| 8,820,701 | B1 | 9/2014 | Eichinger | |
| 9,205,906 | B1 | 12/2015 | Fichinger | |
| 9,376,191 | B1 | 6/2016 | Jaszewski | |
| 9,463,859 | B1 | 10/2016 | Cooper, III et al. | |
| 9,481,434 | B1 | 11/2016 | Eichinger et al. | |
| 9,616,986 | B1 | 4/2017 | Gilk et al. | |
| 9,623,946 | B2 | 4/2017 | Delise | |
| 9,643,703 | B1 | 5/2017 | Eichinger | |
| 9,701,383 | B1 | 7/2017 | Stuber et al. | |
| 9,764,813 | B1 | 9/2017 | Zarembka et al. | |
| 9,776,699 | B1 | 10/2017 | Alby | |
| 9,783,278 | B1 | 10/2017 | Dannenberg et al. | |
| 9,789,945 | B1 | 10/2017 | Vaninetti et al. | |
| 9,963,213 | B1 | 5/2018 | Jaszewski et al. | |
| 9,969,475 | B1 | 5/2018 | Waisanen | |
| 10,005,536 | B2 | 6/2018 | Fukuchi et al. | |
| 10,124,871 | B1 | 11/2018 | Eichinger et al. | |
| 10,246,173 | B1 | 4/2019 | Ingebritson | |
| 10,464,648 | B1 | 11/2019 | Amerling et al. | |
| 10,696,367 | B1 | 6/2020 | Ingebritson et al. | |
| 10,787,236 | B1 | 9/2020 | Erickson et al. | |
| 11,097,824 | B1 | 5/2021 | Anderson, Jr. | |
| 11,066,140 | B1 | 7/2021 | Huffer et al. | |
| 11,866,137 | B1 | 1/2024 | Jaszewski | |
| 2009/0001244 | A1 | 1/2009 | Lucier et al. | |
| 2009/0170384 | A1 | 7/2009 | Balogh et al. | |
| 2011/0065340 | A1 | 3/2011 | Klawitter et al. | |
| 2013/0316603 | A1 | 11/2013 | Hagi | |
| 2019/0344873 | A1 | 11/2019 | Kimpara | |
| 2021/0394882 | A1 | 12/2021 | Waldvogel | |
| 2023/0102741 | A1 | 3/2023 | Fergus | |
| 2023/0192260 | A1 * | 6/2023 | Dannenberg | B63H 20/00 114/144 R |
| 2023/0257095 | A1 | 8/2023 | Waldvogel | |
| 2024/0051650 | A1 | 2/2024 | Nickols | |

FOREIGN PATENT DOCUMENTS

| | | | | |
|---|---|---|---|---|
| EP | 4155191 | A1 * | 3/2023 | B63H 20/02 |
| JP | S5654697 | | 5/1981 | |
| JP | S6479000 | | 3/1989 | |
| JP | 3976290 | | 9/2007 | |
| WO | 2022045986 | | 3/2022 | |

OTHER PUBLICATIONS

Evinrude, Evinrude E-Tec 25 HP, last accessed May 11, 2021, available at: https://www.evinrude.com/en-US/e-tec/etec-full-specs.html#tab=12.

Honda Marine, Honda BF25-30hp Outboard Engines, last accessed May 11, 2021, available at: https://marine.honda.com/outboards/motor-detail/BF25-30#specs.

Honda Marine, Honda Marine BF25DK3 SHGA S/N: BATJ-1501086 Parts List, last accessed Dec. 4, 2018, availableat: http://peparts.honda.com/marine#/serial.

Honda Motor Co., Ltd., BF25D-BF30D Owner's Manual, 2017.

Mercury Marine, 2010 Mercury Marine 25/30 EFI FourStroke Owner's Manual.

Mercury Marine, 2015 Mercury Marine 15/20 FourStroke Outboard Installation Operation Maintenance WarrantyManual.

PPF Mud Motors, "PPF Wood Duck 6.5 HP Mud Motor," screenshot from photo gallery, admitted prior art, last accessed Jul. 5, 2021, available at https://ppfmudmotors.com/gallery/#swipebox.

PPF Mud Motors, "Quick Drop Transom Mount," website, available at least as early as Sep. 15, 2017, lastaccessed Jul. 5, 2021, available at http://ppfmudmotors.com/quick-drop-transom-mount/—this is the webpagescreenshot.

Remigo, E-Outboard, webpage and 5 photographs, Sep. 26, 2020, available at https://web.archive.org/web/20200926115717/https://remigo.eu/.

Suzuki Motor Corporation, DF25A-DF30A Owner's Manual, Oct. 2015.

Suzuki Motor Corporation, Suzuki DF 30A Parts Listings—2018, last accessed Dec. 4, 2018, available at: https://www.brownspoint.com/store/pc/BP_AP_AssemblyDetail.asp?ID=19761.

Unpublished U.S. Appl. No. 17/852,944.

Yamaha Motor Co., Ltd., 2013 Yamaha Outboard 30hp—F30LA Steering Friction Section, last accessedDec. 4, 2018, available at: https://www.crowleymarine.com/yp/KE329296/steering-friction-f30la-2013-30hp.

Yamaha Motor Co., Ltd., 2013 Yamaha Outboard 30hp—F30LA, Bracket 1 Section, last accessed Dec. 4, 2018, available at: crowleymarine.com.

Yamaha Motor Co., Ltd., Yamaha F25 T25 Owner's Manual, May 2013.

Yamaha Motor Co., Ltd., Yamaha F25SMHC—2006 and Later, Parts List, last accessed Dec. 4, 2018, available at: https://shop.yamahaonlineparts.com/OEMpartfinder.htm.

Yamaha Motor Co., Ltd., Yamaha 30hp Co-Pilot Manual, Feb. 2010.

Declaration of Prior Art.

Unpublished U.S. Appl. No. 17/487,116.

Unpublished U.S. Appl. No. 17/509,739.

Unpublished U.S. Appl. No. 17/509,739, "Integrated Copilot and Locking Mechanism for Marine Drives".

Unpublished U.S. Appl. No. 17/852,944, "Copilot Devices and Apparatuses for Supporting Marine Drives Having a Copilot Device".

Office Action issued in U.S. Patent Application No. 17/487, 116, dated Nov. 8, 2024.

* cited by examiner

COPILOT DEVICES AND APPARATUSES FOR SUPPORTING MARINE DRIVES HAVING A COPILOT DEVICE

FIELD

The present disclosure relates to apparatuses for supporting marine drives with respect to a marine vessel, in particular to such apparatuses having a copilot device.

BACKGROUND

The following are incorporated herein by reference, in entirety.

U.S. Pat. No. 9,205,906 discloses a mounting arrangement for supporting an outboard motor with respect to a marine vessel extending in a fore-aft plane. The mounting arrangement comprises first and second mounts which each have an outer shell, an inner wedge concentrically disposed in the outer shell, and an elastomeric spacer between the outer shell and the inner wedge. Each of the first and second mounts extend along an axial direction, along a vertical direction that is perpendicular to the axial direction, and along a horizontal direction which is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/509,739 discloses an apparatus for removably supporting a marine drive on a marine vessel. The apparatus has a transom bracket assembly for mounting to the marine vessel, a steering bracket for coupling the marine drive to the transom bracket assembly so the marine drive is steerable relative to the transom bracket assembly and the marine vessel; and an integrated copilot and locking mechanism configured to retain the steering bracket in a plurality of steering orientations. The mechanism is further configured to lock and alternately unlock the steering bracket relative to the transom bracket assembly such that in a locked position the marine drive is retained on the transom bracket assembly and such that in an unlocked position the marine drive is removable from the transom bracket assembly.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An apparatus is for supporting a marine drive on a marine vessel. The apparatus comprises a transom bracket having a swivel cylinder and a steering bracket configured to couple the marine drive to the transom bracket. The steering bracket has a steering arm and a swivel tube seated in the swivel cylinder. Steering of the steering arm relative to the transom bracket rotates the swivel tube in the swivel cylinder and thereby steers the marine drive. The apparatus has a novel copilot device configured to frictionally restrain rotation of the swivel tube in the swivel cylinder by applying diametrically opposing pushing and pulling forces on the swivel tube. Varying the diametrically opposing pushing and pulling forces varies a resistance to steering of the outboard motor relative to the transom bracket. In certain non-limiting embodiments, the copilot device is configured to apply the diametrically opposing pushing and pulling forces on at least half of an outer circumference of the swivel tube. In certain non-limiting embodiments, the copilot device is configured to apply the diametrically opposing pushing and pulling forces on at least three fourths of an outer circumference of the swivel tube.

In certain non-limiting embodiments, the copilot device has a friction head which applies the diametrically opposing pushing and pulling forces on the swivel tube. The friction head has first head portion and a second head portion which diametrically opposes the first head portion. The copilot device is configured to apply the diametrically opposing pushing and pulling forces on the swivel tube by increasingly pressing the first head portion on a first side of an outer circumference of the swivel tube and simultaneously increasingly pulling the second head portion on a diametrically opposite, second side of the outer circumference of the swivel tube.

In certain non-limiting embodiments, the copilot device further includes an actuator arm. Translation of the actuator arm in a first axial direction causes the friction head to increasingly apply said diametrically opposing pushing and pulling forces on the swivel tube. Translation of the actuator arm in an opposite, second axial direction causes the friction head to decreasingly apply said diametrically opposing pushing and pulling forces on the swivel tube.

In certain non-limiting embodiments, a release device is for automatically disengaging the copilot device from the swivel tube. The release device has a plunger located in the outer end of the actuator arm. Manually pressing the plunger causes the inner end of the actuator arm to automatically withdraw away from the outer circumference of the swivel tube. The plunger is retained in a locked position by a detent mechanism and wherein the plunger is spring biased towards an unlocked position.

BRIEF DESCRIPTION OF THE DRAWINGS

Examples are described with reference to the following drawing figures. The same numbers are used throughout to reference like features and components.

DETAILED DESCRIPTION

Figure 1:
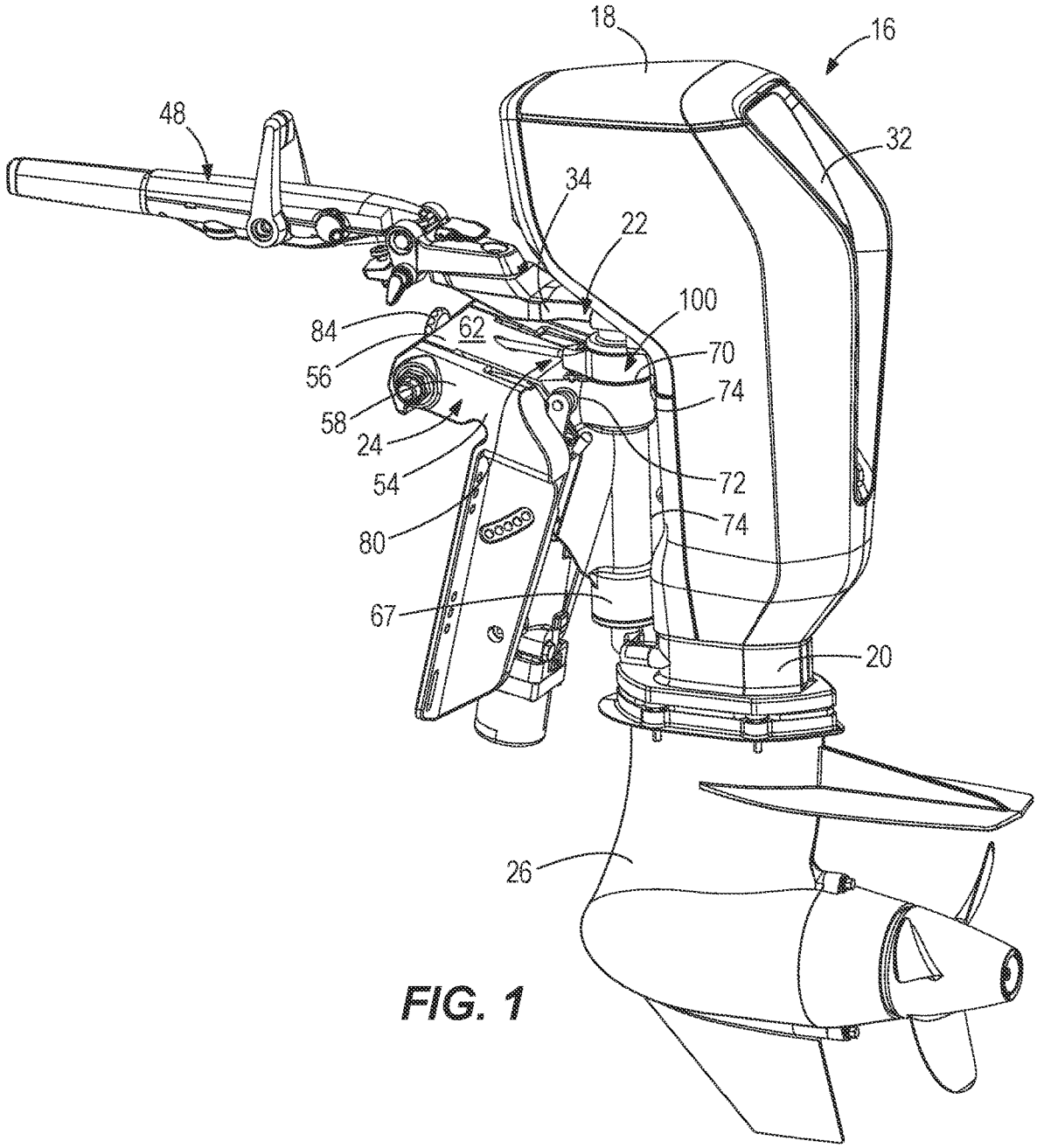
FIG. 1 is a perspective view of an apparatus for supporting a marine drive with respect to a marine vessel, in particular having a copilot device according to the present disclosure.

FIG. 1 illustrates a marine drive, which in this example is a non-limiting example of an outboard motor 16. The outboard motor 16 has an upper cowling 18 and a driveshaft housing 20 which extends downwardly relative to the upper cowling 18 to a lower gearcase 26. Generally, the outboard motor 16 axially extends from the upper cowling 18 to the lower gearcase 26, laterally extends from a port side to a starboard side, and longitudinally extends from an aft face 32 to a steering bracket 22. The outboard motor 16 is coupled to a transom of a marine vessel (not shown) by the combination of a steering bracket 22 and transom bracket assembly 24. As is conventional and further described herein below, the steering bracket 22 is steerable relative to the transom bracket assembly 24 about a steering axis 76, shown in FIG. 2.

Referring to FIGS. 1-4, the steering bracket 22 is fixed to and extends from the midsection of the outboard motor 16, generally between the lower portion of the upper cowling 18 and the upper portion of the driveshaft housing 20. The steering bracket 22 has a steering arm 34 and a swivel tube 36 which extends transversely from the steering arm 34. The swivel tube 36 extends from an upper end 38 to a lower end and has a smooth outer circumferential surface 37. The upper end 38 is fixed to the steering arm 34 by a fastener 40. As further described herein below, the swivel tube 36 is seated in and steerable relative to a corresponding swivel cylinder 64 of the transom bracket assembly 24.

The steering arm 34 has a first end 44 which is fixed to a supporting frame or other component of the outboard motor 16, and an opposing second end 46 which is fixed to a conventional tiller handle 48, as illustrated in FIG. 1, for example by fasteners extending through bores 50 in an end wall 52 of the steering arm 34. In the illustrated example, the tiller handle 48 like what is disclosed in the presently-incorporated U.S. Pat. No. 9,764,813; however for the purposes of the present disclosure, the type and configuration of the tiller arm can vary from what is illustrated. As will be understood by one having ordinary skill in the art, manually steering of the tiller handle 48 steers the outboard motor 16 about the steering axis 76 and thus affects the direction of travel of the marine vessel.

Figure 2:
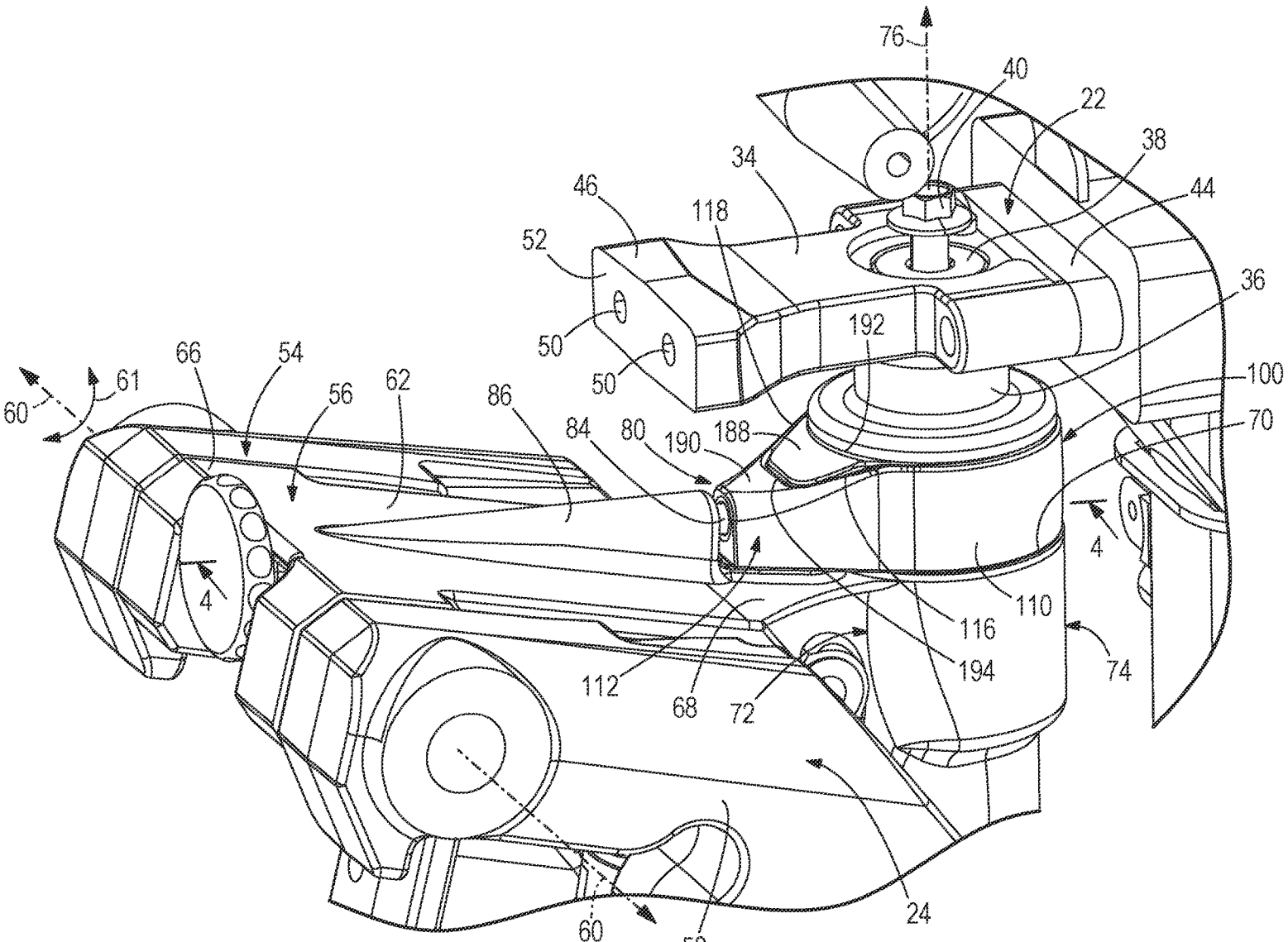
FIG. 2 is a closer perspective view of a first embodiment of a copilot device according to the present disclosure.
Figure 3:
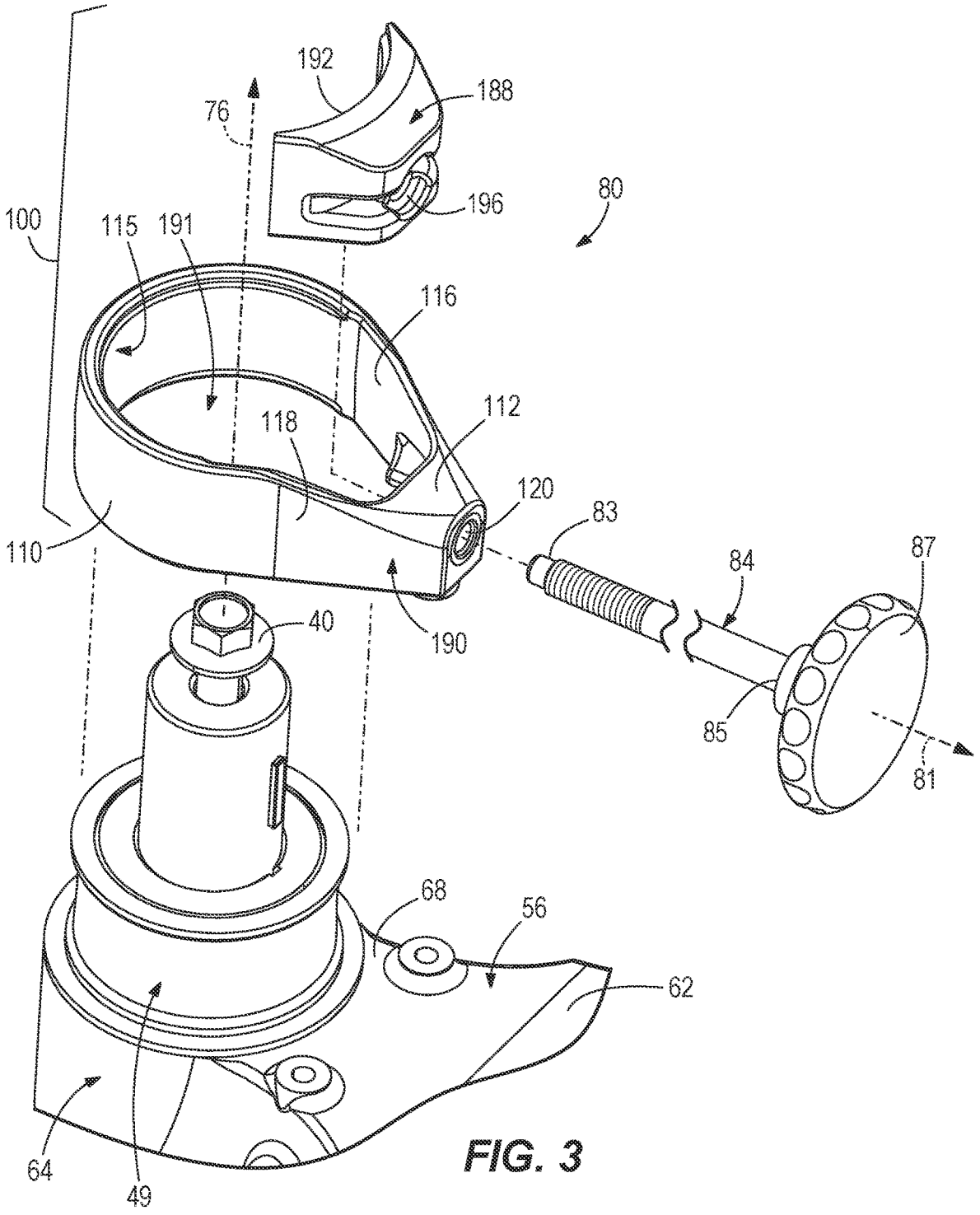
FIG. 3 is an exploded view of the copilot device.
Figure 4:
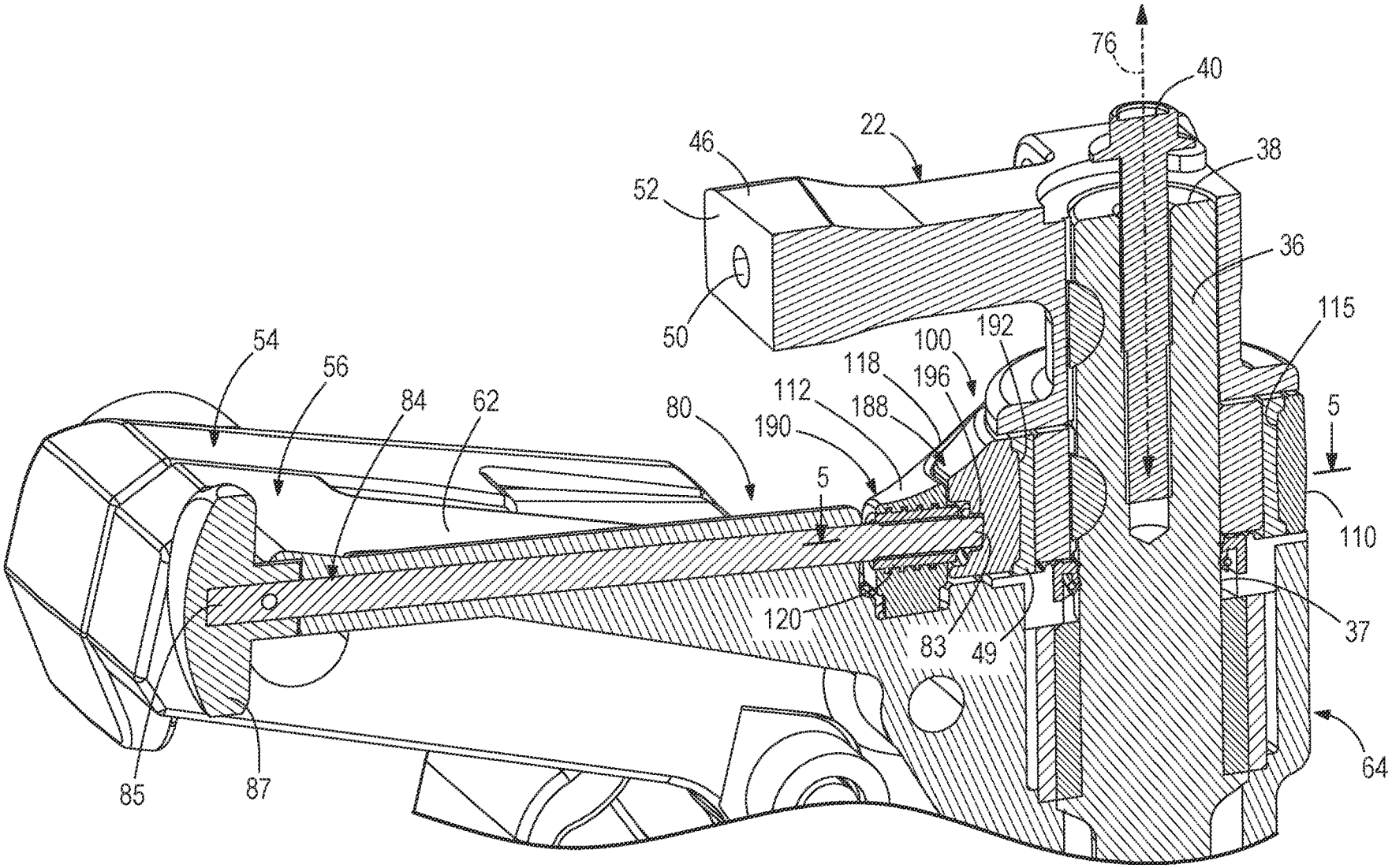
FIG. 4 is a view of Section 4-4, taken in FIG. 2.

As illustrated in FIGS. 2-4, the transom bracket assembly 24 has a transom bracket 54 and a swivel bracket 56 which is pivotably coupled to the transom bracket 54. The transom bracket 54 has a pair of C-shaped arms 58 which are clamped to the top of the transom in a fixed arrangement. The swivel bracket 56 is pivotably coupled to the upper end of the C-shaped arms 58 along a lateral trim axis 60 such that the swivel bracket 56 is pivotable (i.e., trimmable) up and down about the trim axis 60 in the direction of arrows 61.

Referring to FIGS. 2-4, the swivel bracket 56 has a swivel arm 62 and the swivel cylinder 64. The swivel arm 62 has a first end 66 which is pivotably coupled to the C-shaped arms 58 of the transom bracket 54. The swivel arm 62 has an opposing second end 68 which is fixed to or formed with the swivel cylinder 64. The swivel cylinder 64 has a front end 72 and a radially opposite back end 74. The front end 72 is located proximate to the second end 68 of the swivel arm 62. The swivel cylinder 64 defines an elongated cylindrical passage which extends from a lower end 67 to an upper end 70.

The swivel tube 36 is seated in the cylindrical passage of the swivel cylinder 64 in a manner which facilitates steering rotation of the outboard motor 16 about the steering axis 76. Steering of the steering arm 34 relative to the transom bracket 54 rotates the swivel tube 36 within the swivel cylinder 64 and thereby steers the outboard motor 16 about the steering axis 76.

The above-described steering bracket 22 and transom bracket assembly 24 are generally configured like the embodiments disclosed in the presently incorporated U.S. Patent Application No. 17,509,739. However for the purposes of the present disclosure, it should be understood that the transom bracket assembly does not need to have a swivel bracket which is pivotable relative to a transom bracket. In other arrangements, the transom bracket assembly are a monolithic component or several components which are not pivotable about a trim axis. Reference is made to the above-incorporated U.S. patents and patent applications, which illustrate various other suitable arrangements facilitating pivoting movement of a swivel bracket relative to a transom bracket.

Presently incorporated U.S. Patent Application No. 17,509,739 discloses a copilot device for use with the above-described steering bracket 22 and transom bracket assembly 24. During research and development in this field, the present inventors determined it would be advantageous to improve upon the copilot device of the '739 application, in particular by increasing the circumferential area of frictional engagement between the copilot device and the steering tube. More specifically, the copilot device set forth in the '739 application is configured to frictionally engage (i.e., press against) one side of the swivel tube, which in some examples further presses the opposite side of the swivel tube against the side of the swivel cylinder. During research and development, the present inventors realized that it would be possible and in some situations advantageous to reconfigure the copilot device in such a way that both sides of the swivel tube are frictionally engaged in a clamping- or squeezing-type configuration. This was found to improve performance and reliability. The inventors also realized that frictionally engaging both sides of the swivel tube in a pushing/pulling (clamping or squeezing) configuration surprisingly maintains center alignment of the steering tube in the steering cylinder, along the steering axis, thus potentially enhancing useful life of the product. The inventors also realized that frictionally engaging both sides of the swivel tube advantageously helped reduce noise, vibration and harshness during use of the apparatus. The present disclosure is a result of the present inventor's realization of the above-described areas for improvement on known configurations and particularly their resulting efforts to provide improved copilot devices which better facilitate known copilot functionalities in accordance with the above.

The present figures illustrate embodiments of novel copilot devices according to the present disclosure, each of which is configured to frictionally restrain rotation of the swivel tube 36 within the swivel cylinder 64 by applying diametrically opposed pushing and pulling forces on the swivel tube 36, i.e., in a squeezing/clamping arrangement.

FIGS. 3-6 illustrate a first embodiment of a copilot device 80. The copilot device 80 has a friction head 100 and an actuator arm 84 which is threadingly engaged with the friction head 100. The friction head 100 extends around the swivel tube 36 and is located above the swivel cylinder 64, as illustrated by the dash-dot lines in FIG. 3. The actuator arm 84 extends from the friction head 100 toward the C-shaped arms 58 of the transom bracket 54. In some embodiments, the swivel bracket 56 includes a housing 86 through which the actuator arm 84 extends and is supported within, as shown in FIG. 2. The housing 86 provides a torque-reaction device, as will be further described herein below. In other examples, the housing 86 can instead be a bracket or any other rigid feature capable of providing a torque reactive force, as will be further described herein below.

The friction head 100 has a first head portion 188 and a second head portion 190, which in the first embodiment are separate parts. The friction head 100 defines a receiving area 191 which surrounds the swivel tube 36. The first head portion 188 has an inner side 192 and an opposite outer side 194. A bore 196 extends into the outer side 194. The inner side 192 has an inner face having a curvature which generally matches the outer circumference of the swivel tube 36. As will be described below, the inner side 192 is configured to frictionally engage the outer circumference of the swivel tube 36 when the copilot device 80 is engaged.

The second head portion 190 has a mating portion 112 and a harness 110 which is integrally formed with the mating portion 112 via a first and a second arm 116, 118 extending therefrom. The mating portion 112 has a threaded through-bore 120 which is aligned with the bore 196 of the first head portion 188. The first arm 116 and the second arm 118 are located on radially opposing sides of the mating portion 112, respectively, and extend from opposing ends of the harness 110. The harness 110 extends peripherally about the swivel tube 36. The harness 110 has a curved inner face 115 which generally has the same curvature as the curved inner side of the first head portion 188 and is for frictionally engaging the outer circumference of the swivel tube 36 on an opposite side relative to the first head portion 188. The first head portion 188 is located between the mating portion 112 of the second head portion 190 and the swivel tube 36. As further described herein below, upon engagement of the copilot device 80, the first head portion 188 along the inner side 192 and the harness 110 of the second head portion 190 along the curved inner face 115 are diametrically pressed and pulled, respectively, onto opposite sides of the swivel tube 36 such that the copilot device 80 frictionally engages opposite sides of the swivel tube 36 and thus restrains steering of the outboard motor 16. Preferably the copilot device 80 frictionally engages at least half or more of the outer circumference 37 of the swivel tube 36 including its opposite sides, and even more preferably the copilot device 80 frictionally engages at least three fourths or more of the outer circumference 37 of the swivel tube 36 including its opposite sides.

The actuator arm 84 is manually rotatable about an engagement axis 81, which extends transversely from the steering axis 76. The actuator arm 84 has an inner end 83 and an outer end 85. The inner end 83 is threadingly engaged with the through-bore 120 on the second head portion 190 and protrudes into the bore 196 on the first head portion 188. The outer end 85 has a knob 87 which is manually rotatable. Rotation of the knob 87 rotates the actuator arm 84 relative to the friction head 100, which via the threaded connection causes second head portion 190 to travel along the actuator arm 84, such that the actuator arm 84 effectively moves inwardly or outwardly relative to the second head portion 190, depending on the direction of rotation. In other words, the axial location of the actuator arm 84 remains generally stationary relative to the housing 86, as the second head portion 190 moves inwardly or outwardly along the actuator arm 84, depending on the direction of rotation. In the illustrated example, rotation of the knob 87 in a first direction (e.g., clockwise) effectively causes the actuator arm 84 to move into the friction head 100. As the actuator arm 84 increasingly moves into the friction head 100, the inner end 83 of the actuator arm 84, via engagement with the bore 196, increasingly pushes the first head portion 188 towards the swivel tube 36. This causes the inner side 192 of the first head portion 188 to apply a corresponding pushing force on the swivel tube 36, i.e., radially toward the steering axis 76. Increasingly rotating the knob 87 in the first direction increases the frictional engagement between the first head portion 188 and the swivel tube 36 and thus increases the resistance to steering via the tiller handle 48.

Simultaneously upon rotation of the knob 87 in the first direction, the threaded engagement between the inner end 83 of the actuator arm 84 and the threaded through-bore 120 of the second head portion 190 causes the second head portion 190 to move outwardly relative to the outboard motor 16 along the actuator arm 84. This causes the curved inner face 115 to apply a corresponding diametrically opposing pulling force on the opposite side of the swivel tube 36, i.e., radially toward the steering axis 76, which is pulling force is opposed by the noted torque reaction force provided on the stem of the knob 87 by the fixed housing 86. Continued rotation of the actuator arm 84 increases the noted pulling force on the swivel tube 36 and thus increases the noted frictional restriction to steering rotation of the tiller handle 48.

The combination of pushing and pulling forces noted above thus effectively frictionally clamps or squeezes the swivel tube 36, providing an effective means for restraining steering of the outboard motor 16 advantageously without pushing the swivel tube 36 off center with respect to the swivel cylinder 64.

Figure 6:
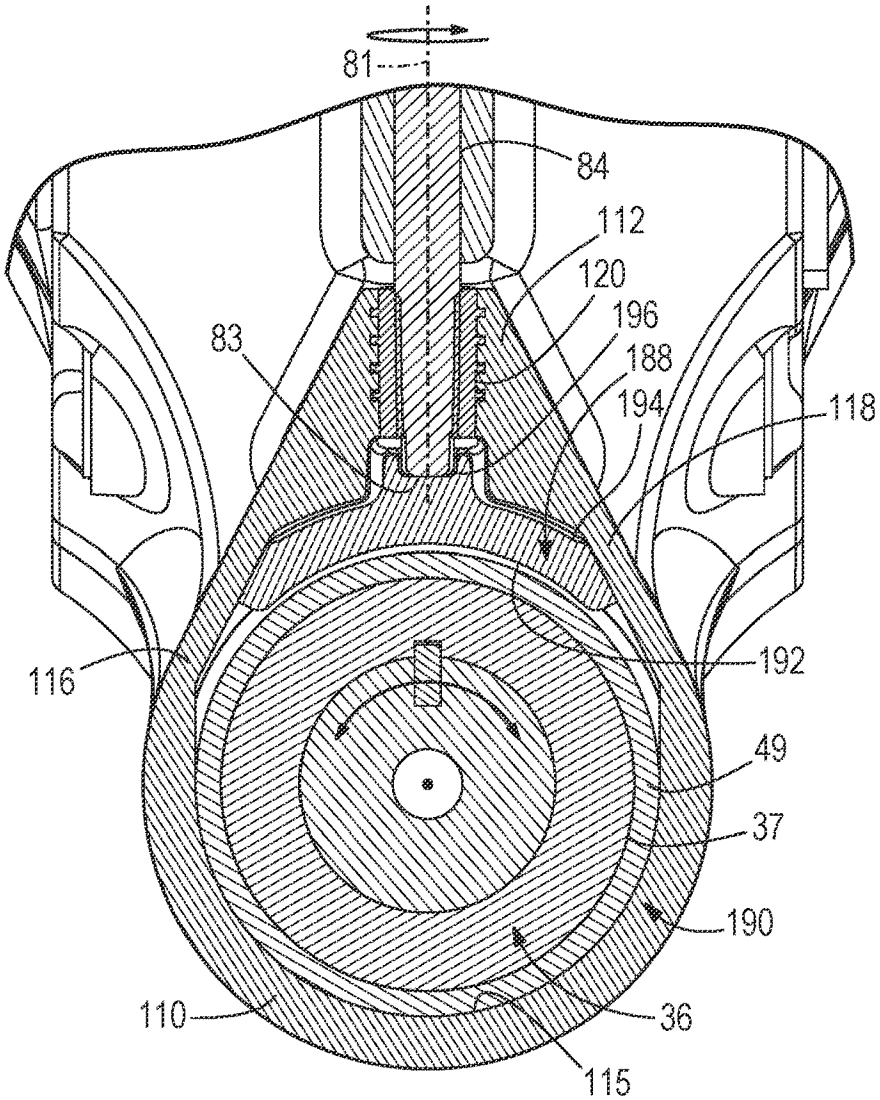
FIG. 6 is a view like FIG. 5, illustrating the copilot device in a disengaged position.
Figure 5:
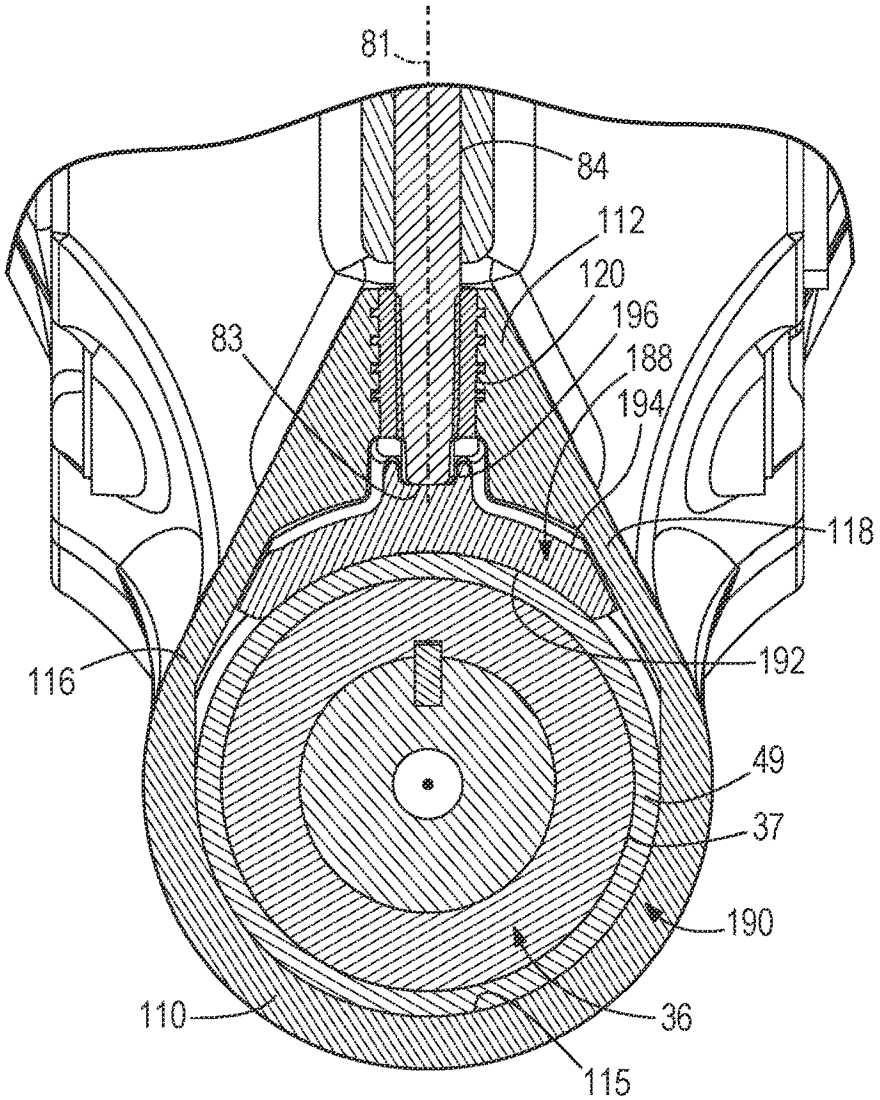
FIG. 5 is a view of Section 5-5, taken in FIG. 4, illustrating the copilot device in an engaged position.

To disengage the copilot device 80, the actuator arm 84 is rotated in the opposite, second rotation direction (in this example, counter-clockwise) which causes the second head portion 190 to move in an opposite direction along the actuator arm 84. This decreases the noted diametrically opposing pushing and pulling forces applied on the swivel tube 36. More specifically, movement of the inner end 83 of the actuator arm 84 outwardly of the friction head 100 reduces the pushing force in the bore 196 of the first head portion 188 until the first head portion 188 no longer applies the pushing force on the side of the swivel tube 36. Simultaneously, the second head portion 190 moves along the actuator arm 84, toward the outboard motor 16, which reduces the noted pulling force until the second head portion 190 no longer applies the pulling force on the opposite side of the swivel tube 36. This frees the swivel tube 36 for rotation within the swivel cylinder 64 and thus facilitates less-restrained steering motion of the outboard motor 16. Thus, as illustrated in FIGS. 5-6 and described herein above, manually rotating the knob 87 effectively facilitates selective increasing or decreasing of the resistance to steering of the steering arm 34 relative to the transom bracket 54.

Optionally, the copilot device 80 has an annular friction ring 49 which is located radially between the friction head 100 and the swivel tube 36. The friction ring 49 is made of a suitable material, such as polyurethane, and/or the like, for achieving a strong and durable frictional engagement on the outer circumference 37 of the swivel tube 36. Other suitable examples include any ceramic/metallic/polymer composite known for use in automotive and/or bicycle brake shoes/pads. Any material that provides a reasonable balance of friction coefficient and wear resistance will suffice. In some embodiments, there may be an advantage in using a non- or less-flexible material. In such embodiments, a break or breaks in the annular shape may be advantageous.

Figure 7:
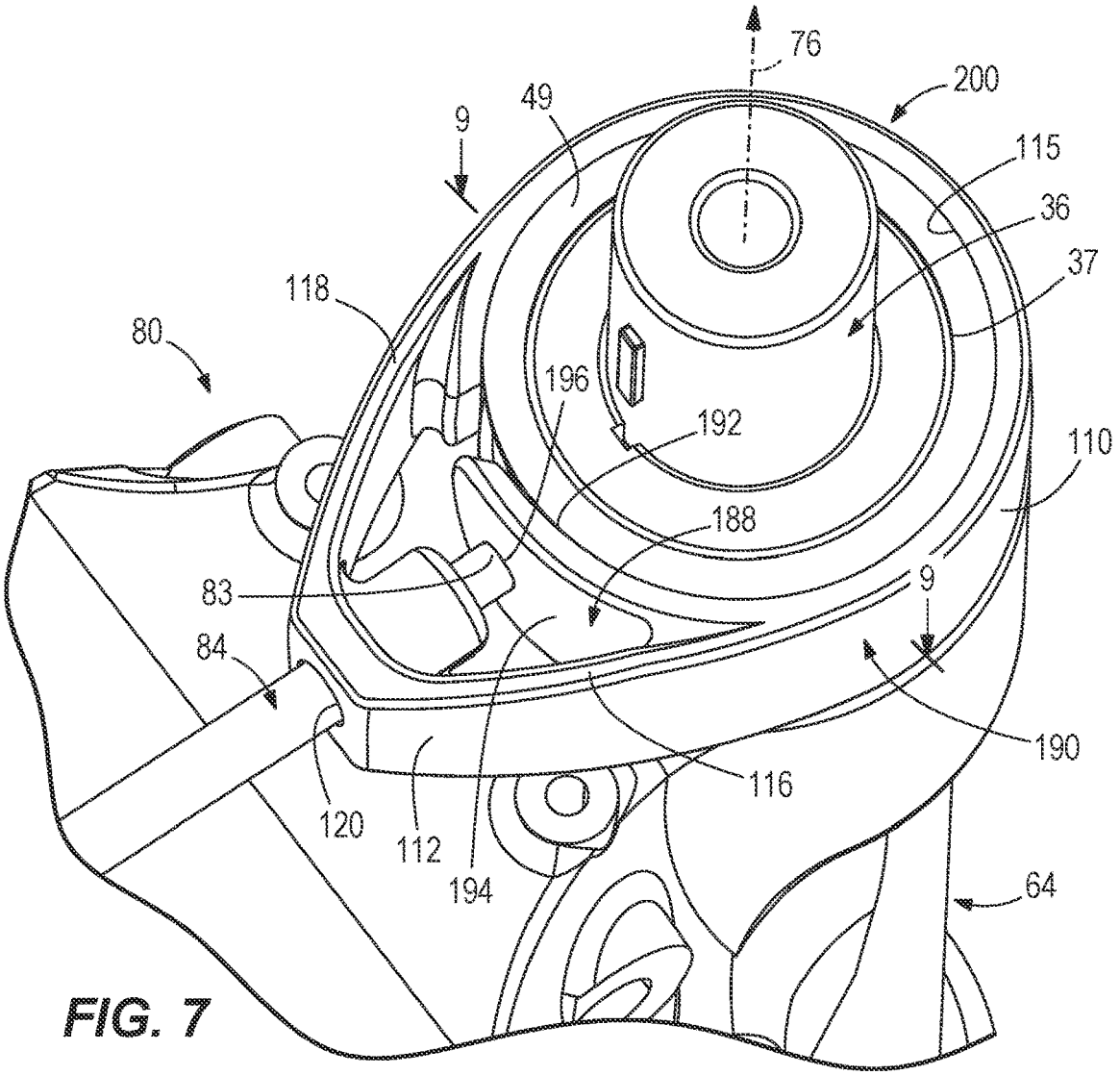
FIG. 7 is a perspective view of a second embodiment of a copilot device according to the present disclosure.
Figure 8:
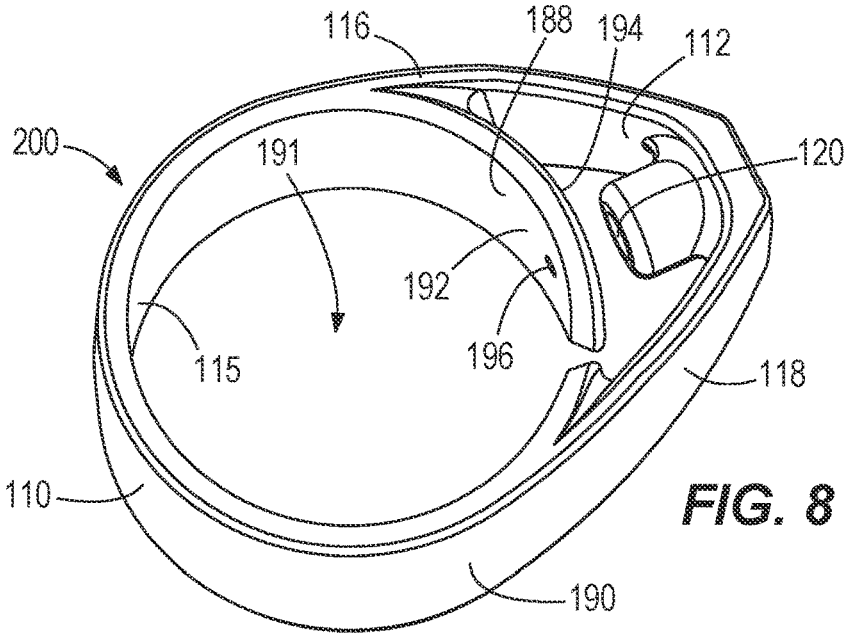
FIG. 8 is a perspective view of a friction head of the copilot device illustrated in FIG. 7.
Figure 9:
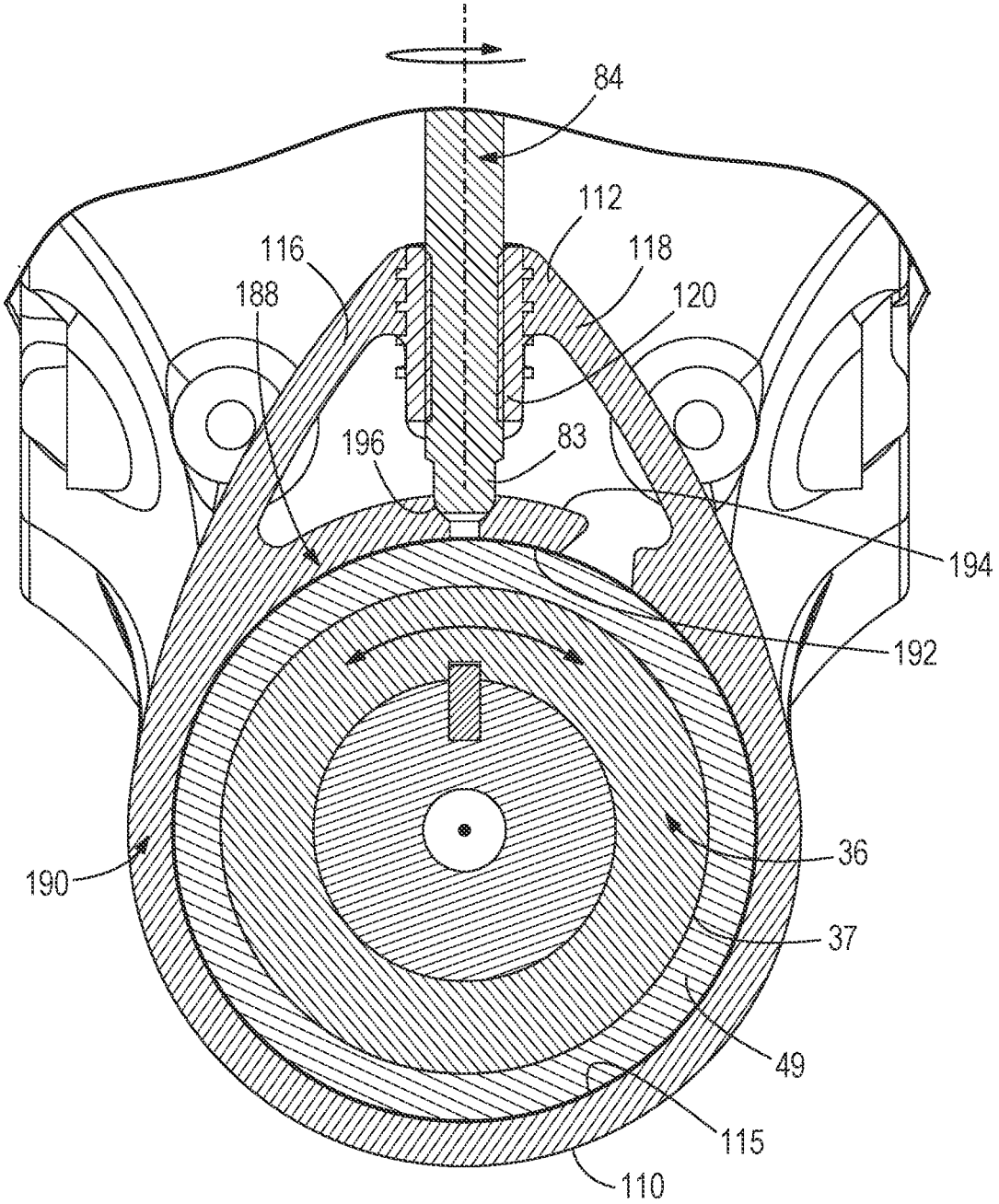
FIG. 9 is a view of Section 9-9, taken in FIG. 7, illustrating the copilot device in a disengaged position.

FIGS. 7-9 illustrate a second embodiment of the copilot device 80, having an actuator arm 84 and a different type of friction head 200. Like the first embodiment, the friction head 200 extends peripherally around the swivel tube 36 and is positioned above the swivel cylinder 64. The actuator arm 84 extends from the friction head 200 toward the C-shaped arms 58 of the transom bracket 54. The friction head 200 defines the receiving area 191 for the swivel tube 36 and the first head portion 188. However unlike the first embodiment, friction head 200 is a monolithic component wherein the first head portion 188 is integrally formed with a second head portion 190. The first head portion 188 protrudes into the receiving area 191, adjacent the swivel tube 36.

Like the first embodiment, the first head portion 188 has the inner side 192 which longitudinally opposes the outer side 194, and the bore 196 in the outer side 194. The inner side 192 has a curvature which generally matches the curvature of the second head portion 190. Similar to the first embodiment, the second head portion 190 has the mating portion 112 and the harness 110, which are formed integrally and connected via the first and the second arm 116, 118. The mating portion 112 has the threaded through-bore 120 which is aligned with the bore 196 of the first head portion 188. The first and second arms 116, 118 extend from radially opposing ends of the mating portion 112, adjacent opposite sides of the swivel tube 36, respectively, and are coupled to opposing ends of the harness 110. The harness 110 extends around the swivel tube 36. The harness 110 has the curved inner face 115 with a curvature which is generally same as radial curvature of the curved inner side 192 of the first head portion 188. The actuator arm 84 is threadingly engaged at the inner end 83 with the threaded through-bore 120 on the second head portion 190 and passes through and extends into the bore 196 on the first head portion 188. Like the first embodiment, the first head portion 188 and second head portion 190 are configured to frictionally engage opposite sides of the swivel tube 36, preferably at least half of the outer circumference 37 of the swivel tube 36 or more, and more preferably at least three fourths of the outer circumference 37 of the swivel tube 36 or more.

In use, as illustrated in FIG. 9, the threaded engagement between the actuator arm 84 and the second head portion 190 permits the operator to selectively increase or decrease the resistance to rotational movement of the outboard motor 16 via the steering bracket 22, similar to what is described above regarding the first embodiment. Rotation of the actuator arm 84 in a first rotation direction (e.g., clockwise) causes the actuator arm 84 to effectively move into the friction head 200 which causes the friction head 200 to increasingly apply the diametrically opposing pushing and pulling forces on the swivel tube 36. Movement of the inner end 83 of the actuator arm 84 into the friction head 200 applies a pushing force on the bore 196 of the first head portion 188, which in turn applies a pushing force on the front of the swivel tube 36 toward the steering axis 76. Simultaneously, the threaded engagement between the inner end 83 of the actuator arm 84 and the threaded through-bore 120 of the second head portion 190 causes the second head portion 190 to move away from the outboard motor 16, applying a pulling force on the opposite side of the swivel tube 36. Conversely, rotation of the actuator arm 84 in a second rotation direction decreases the noted diametrically opposing pushing and pulling forces applied on the swivel tube 36, as described herein above.

During further research and development, the present inventors also realized it would be advantageous to provide a copilot device with a quick release functionality, in particular which permits quick release of the frictional engagement from the copilot device on the swivel tube, without requiring manual (counter clockwise) rotation of the handle. The third embodiment shown in FIGS. 10-14 and described herein below provides such functionality.

Referring to FIGS. 10-14, just like the first embodiment, the copilot device 80 has a friction head 300 located above the swivel cylinder 64 and extending around the swivel tube 36. The friction head 300 has the first head portion 188 and the second head portion 190, which are separate parts. The first head portion 188 has an inner side 192 and an opposite outer side 194. The inner side 192 has an inner face having a curvature which generally matches the outer circumference of the swivel tube 36. An actuator arm 84 is threadingly engaged with the friction head 300 and extends from the friction head 300 toward the C-shaped arms 58 of the transom bracket 54. The actuator arm 84 has an inner and outer ends 83, 85 and extends along the longitudinal engagement axis 81. A knob 87 is on the outer end 85 facilitates rotation of the actuator arm 84 by an operator. The inner end 83 is threadingly engaged with the through-bore 120 on the second head portion 190. The actuator arm 84 is rotated to move the copilot device 80 into and between disengaged positions and engaged positions of varying resistance. Like the first embodiment, upon engagement of the copilot device 80, the first head portion 188 and the second head portion 190 are diametrically clamped, respectively, onto opposite sides of the swivel tube 36 such that the copilot device 80 frictionally engages opposite sides of the swivel tube 36 and restrains steering of the outboard motor 16.

Figure 10:
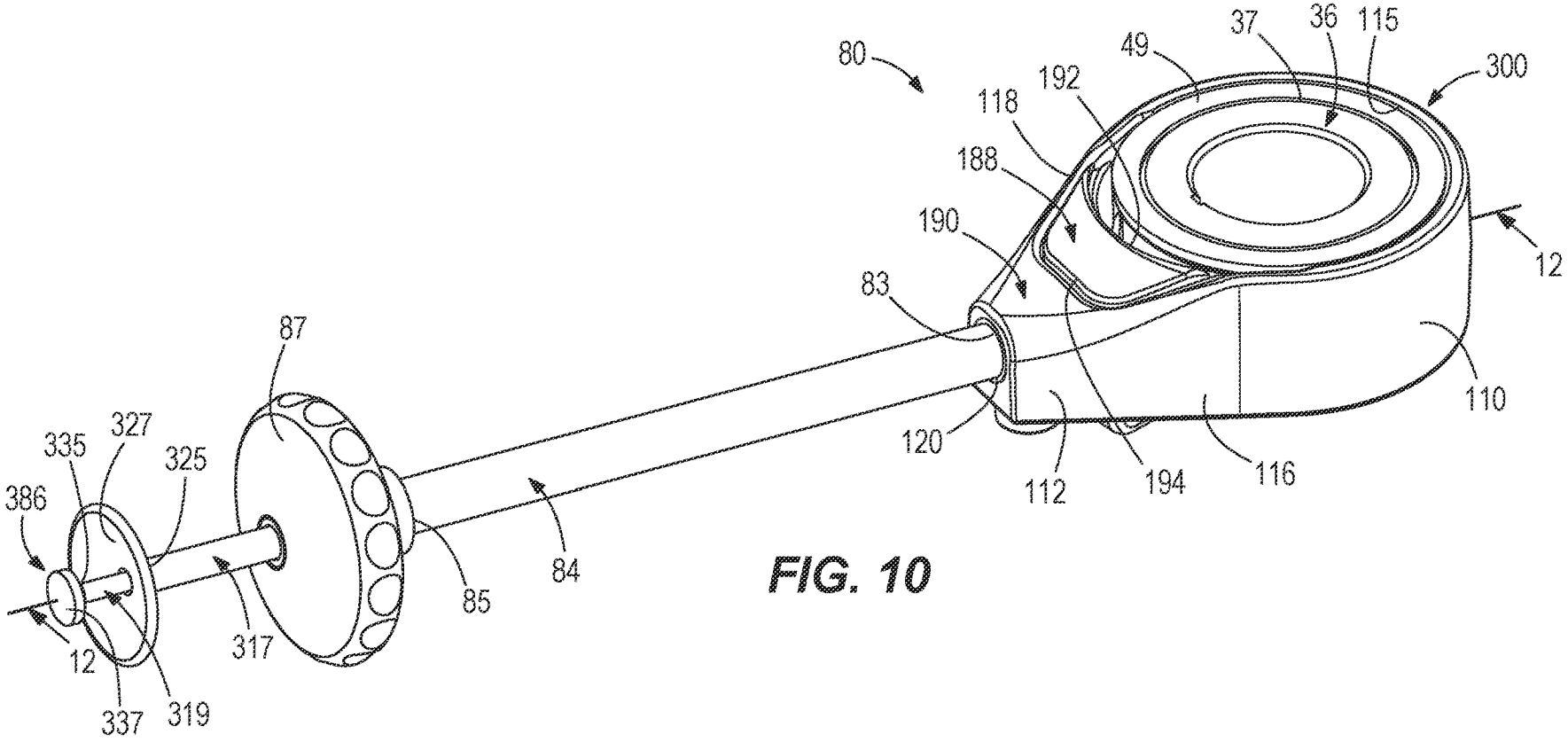
FIG. 10 is a perspective view of a third embodiment of a copilot device having a quick release mechanism for automatically disengaging the copilot device.
Figure 11:
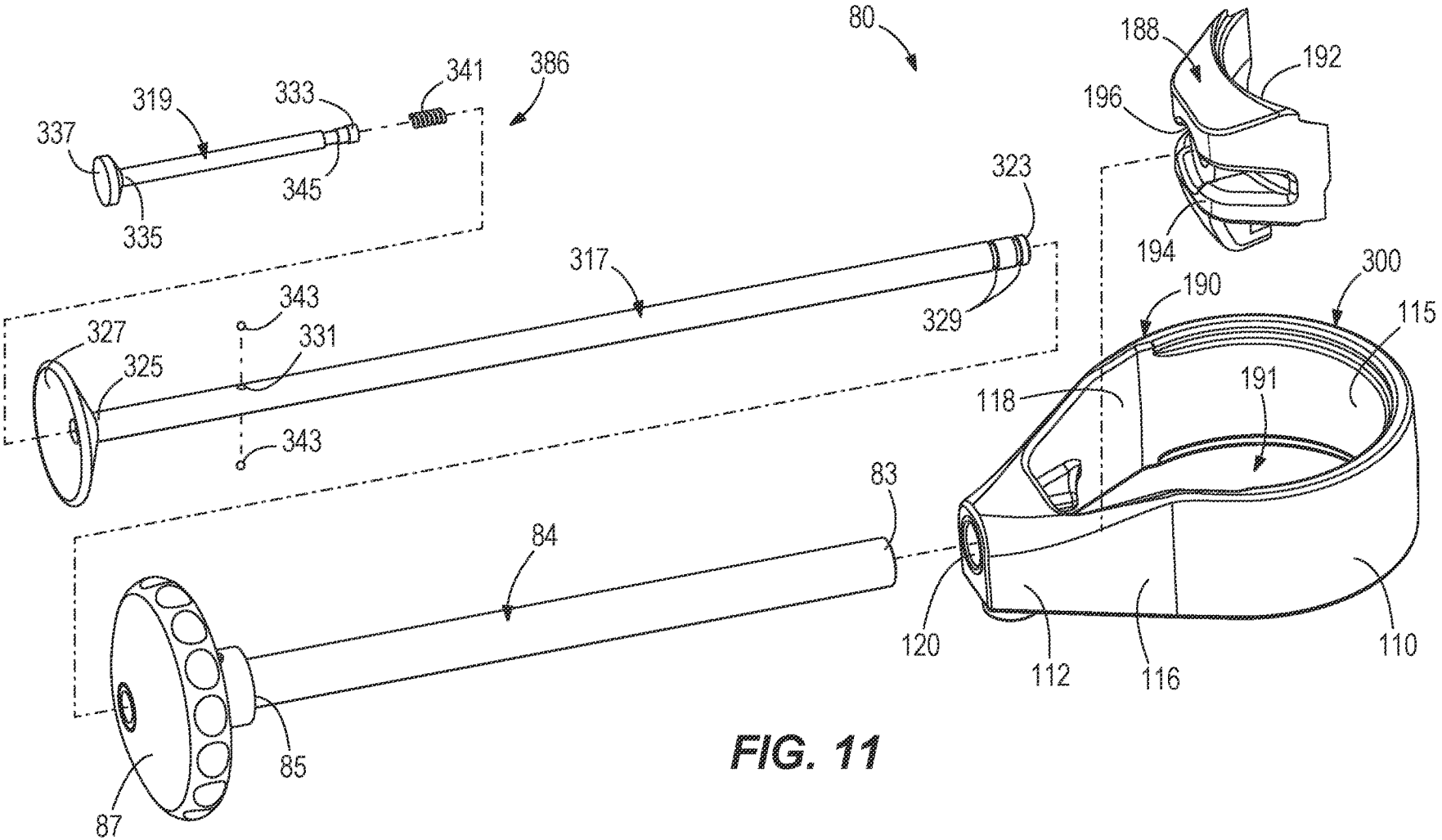
FIG. 11 is an exploded view of the copilot device and quick release mechanism illustrated in FIG. 10.

Unlike the first embodiment, the actuator arm 84 is automatically releasable from the engaged position via a novel quick release mechanism 386. As shown in FIGS. 10 and 11, an engagement arm 317 is telescopically movable within the actuator arm 384 along the engagement axis 81. The engagement arm 317 has an inner end 323 which protrudes from the inner end 83 of the actuator arm 84 and an outer end 325 which protrudes from the outer end 85 of the actuator arm 84. The inner end 83 is axially engaged with the first head portion 188. More specifically, the bore 196 in the first head portion 188 extends from the outer side 194 through to the inner side 192 and further includes a smaller diameter passage 199. The inner end 323 of the engagement arm 317 has a pair of annular grooves 329 which retain snap rings 195 located on axially opposed sides of the smaller diameter passage 199, thus axially attaching the engagement arm 317 to the first head portion 188. A pull handle 327 is located on the outer end 325 and is configured for grasping and pulling by an operator's fingers.

The quick release mechanism 386 has a plunger 319, a compression spring 341, and a pair of detent balls 343. The plunger 319 is telescopically movable within the outer end 325 of the engagement arm 317. The plunger 319 has an inner end 333 located in the engagement arm 317 and an outer end 335 which protrudes from the outer end 325 of the engagement arm 317. The spring 341 tends to expand and thus biases the inner end 333 of the plunger 319, outwardly relative to the outer end 325 of the engagement arm 317. A push head 337 is on the outer end 335 and is configured for pushing by an operator's thumb.

Figure 12:
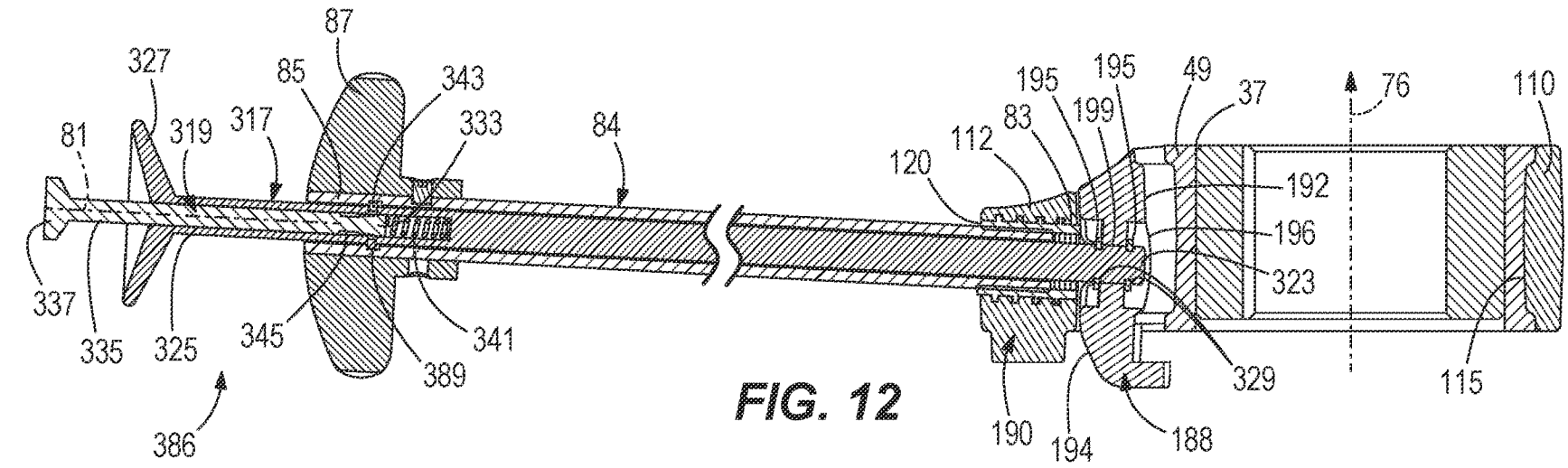
FIG. 12 is a view of Section 12-12, taken in FIG. 10, illustrating third embodiment in a disengaged position.
Figure 13:
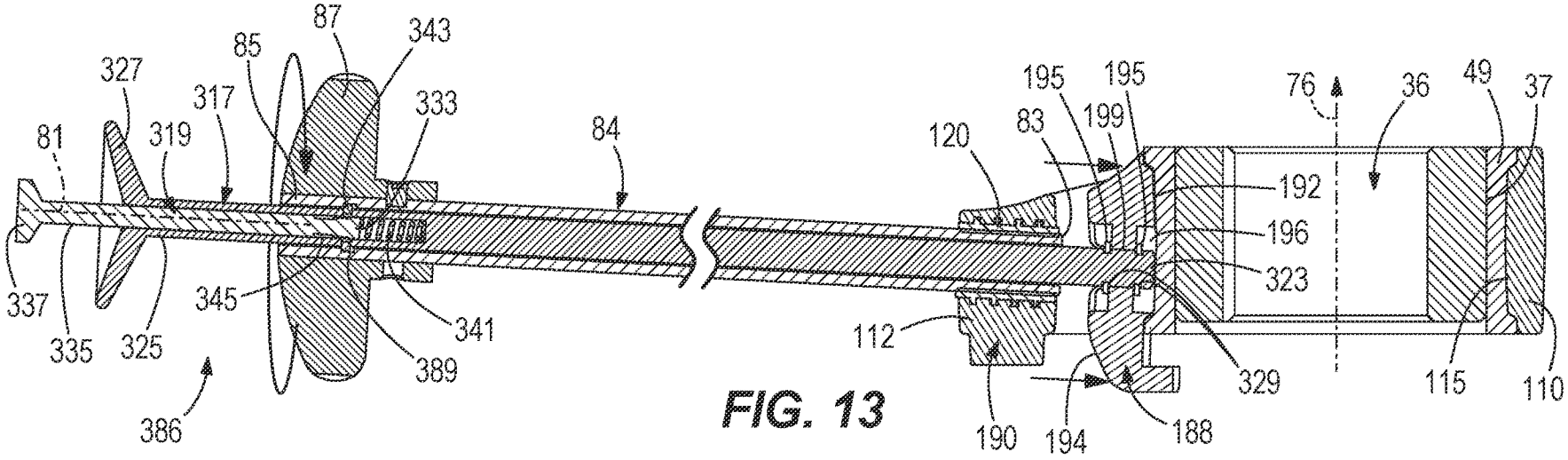
FIG. 13 is a view like FIG. 12, illustrating the third embodiment in an engaged position.

Referring to FIGS. 11-13, an annular groove 389 is located in the outer end 85 of the actuator arm 84, along the inner diameter of the knob 87. A pair of radially opposed detent holes 331 are formed in the outer end 325 of the engagement arm 317. Also, an annular groove 345 is formed on the inner end 333 of the plunger 319.

Referring to FIG. 12, in the locked and engaged position, the detent balls 343 are normally retained in the annular groove 389 in the actuator arm 84 and are engaged with the engagement arm 317, as shown. As stated above, the spring 341 is biased against the plunger 319 such that the detent balls 343 are held in engagement with the detent holes 331 in the engagement arm 317 and the annular groove 389 of the actuator arm 84. The bias of the spring 341 pushes the annular groove 345 out of alignment with the detent balls 343, which retains the detent balls 343 in the annular groove 389, which maintain a fixed engagement between the actuator arm 84 and the engagement arm 317.

Figure 14:
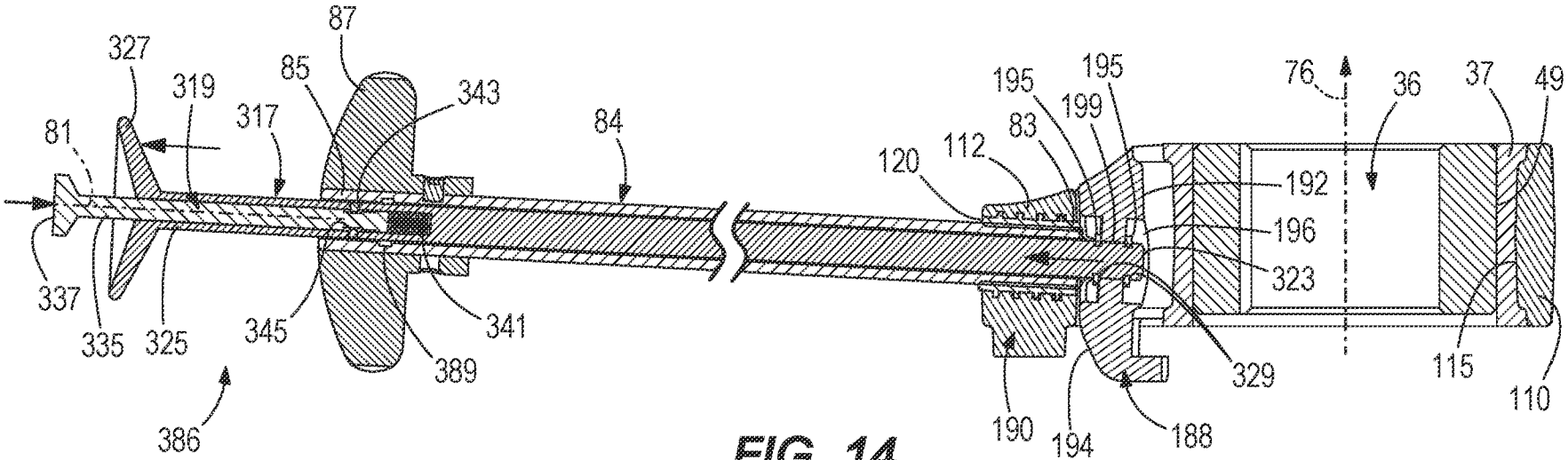
FIG. 14 is a view like FIG. 12, illustrating operation of the quick release mechanism.

To unlock the quick release mechanism 315, as shown in FIG. 14, the operator grasps the pull handle 327 and depresses the head 337 of the plunger 319, which moves the plunger 319 into the actuator arm 84 against the bias of the spring 341. This brings the annular groove 345 into radial alignment with the detent balls 343, which are free to fall radially through the detent holes 331 and into the annular groove 345. This releases the above-noted fixed engagement between the engagement arm 317 and the actuator arm 384. As such, the spring 341 biases the quick release mechanism 386 towards the unlocked position. Once the coupling is released, the engagement arm 317 can be moved axially outward, withdrawing the first head portion 188 from frictional engagement with the swivel tube 36.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An apparatus for supporting a marine drive on a marine vessel, the apparatus comprising:

a transom bracket comprising a swivel cylinder;

a steering bracket configured to couple the marine drive to the transom bracket, the steering bracket comprising a swivel tube seated in the swivel cylinder, wherein steering of the marine drive relative to the transom bracket rotates the swivel tube in the swivel cylinder; and a copilot device comprising a friction head having a first head portion and a second head portion that diametrically opposes the first head portion relative to the swivel cylinder, the first head portion and the second head portion being configured to frictionally restrain rotation of the swivel tube relative to the swivel cylinder by applying a clamping force on the swivel tube.

2. The apparatus according to claim 1, wherein the friction head is configured to apply said clamping force on at least half of an outer circumference of the swivel tube.

3. The apparatus according to claim 1, wherein the friction head is configured to apply said clamping force on at least three fourths of an outer circumference of the swivel tube.

4. The apparatus according to claim 1, wherein varying said clamping force varies a resistance to said steering of the marine drive relative to the transom bracket.

5. The apparatus according to claim 1, wherein the friction head is configured to apply said clamping force on the swivel tube by increasingly pressing the first head portion on a first side of an outer circumference of the swivel tube and simultaneously increasingly pulling the second head portion on a diametrically opposite, second side of the outer circumference of the swivel tube.

6. The apparatus according to claim 5, further comprising a friction ring located radially between the friction head and the swivel tube and being configured to frictionally engage the outer circumference of the swivel tube.

7. The apparatus according to claim 5, wherein together the first head portion and the second head portion comprise a monolithic component.

8. The apparatus according to claim 5, wherein the first head portion and the second head portion comprise separate pieces.

9. The apparatus according to claim 5, wherein the copilot device further comprises an actuator, and wherein translation of the actuator towards the friction head increasingly applies said clamping force on the swivel tube and wherein translation of the actuator away from the friction head causes the friction head to decreasingly apply said clamping force on the swivel tube.

10. The apparatus according to claim 9, wherein the actuator comprises an actuator arm, and wherein rotation of the actuator arm in a first rotation direction causes the actuator arm to move further towards the friction head and wherein rotation of the actuator arm in an opposite, second direction causes the actuator arm to move further away from the friction head.

11. The apparatus according to claim 10, wherein the second head portion extends on opposite sides of the swivel tube and is threadingly engaged with the actuator arm.

12. The apparatus according to claim 10, further comprising a housing on the steering bracket, wherein the actuator arm extends through and is supported within the housing.

13. The apparatus according to claim 10, wherein the actuator arm extends between an outer end and an inner end, wherein the outer end is configured for manual rotation by an operator and wherein the inner end is configured to push the first head portion towards the outer circumference of the swivel tube when the outer end is rotated in the first rotation direction.

14. The apparatus according to claim 13, further comprising a knob on the outer end.

15. The apparatus according to claim 13, further comprising a release device for automatically disengaging the copilot device from the swivel tube.

16. The apparatus according to claim 15, wherein the release device comprises a plunger located in the outer end of the actuator arm, and wherein manually pressing the plunger causes the inner end of the actuator arm to automatically withdraw away from the outer circumference of the swivel tube.

17. The apparatus according to claim 16, wherein the plunger axially extends from the outer end of the actuator arm.

18. The apparatus according to claim 17, wherein the plunger is retained in a locked position by a detent mechanism and wherein the plunger is spring-biased towards an unlocked position.

19. An apparatus for supporting a marine drive on a marine vessel, the apparatus comprising:

a transom bracket comprising a swivel cylinder;

a steering bracket configured to couple the marine drive to the transom bracket, the steering bracket comprising a swivel tube seated in the swivel cylinder, wherein steering of the marine drive relative to the transom bracket rotates the swivel tube in the swivel cylinder and thereby steers the marine drive; and a copilot device configured to frictionally restrain rotation of the swivel tube relative to the swivel cylinder by applying a clamping force on the swivel tube, wherein the copilot device comprises a friction head that applies said clamping force on the swivel tube, and an actuator arm configured to cause the friction head to increasingly apply said clamping force on the swivel tube and alternately to decreasingly apply said clamping force on the swivel tube.

20. A copilot device for an apparatus for supporting a marine drive on a marine vessel, the apparatus comprising a transom bracket comprising a swivel cylinder and a steering bracket configured to couple the marine drive to the transom bracket, the steering bracket comprising a swivel tube seated in the swivel cylinder, wherein steering of the marine drive relative to the transom bracket rotates the swivel tube in the swivel cylinder, the copilot device comprising:

a friction head that is configured to apply a clamping force on the swivel tube, and an actuator configured to cause the friction head to increasingly apply said clamping force on the swivel tube and alternately to decreasingly apply said clamping force on the swivel tube;

wherein the copilot device is configured to frictionally restrain rotation of the swivel tube relative to the swivel cylinder by applying said clamping force on the swivel tube.

21. The copilot device according to claim 20, wherein the friction head comprises first head portion and a second head portion that diametrically opposes the first head portion, and further wherein the copilot device is configured to apply said clamping force on the swivel tube by increasingly pressing the first head portion on a first side of an outer circumference of the swivel tube and simultaneously increasingly pulling the second head portion on a diametrically opposite, second side of the outer circumference of the swivel tube.

22. The copilot device according to claim 21, wherein together the first head portion and the second head portion comprise a monolithic component.

23. The copilot device according to claim 21, wherein the first head portion and the second head portion comprise separate pieces.

24. The copilot device according to claim 21, further comprising a release device for automatically disengaging the copilot device from the swivel tube.

* * * * *